US009683411B1

(12) United States Patent
Kassner et al.

(10) Patent No.: US 9,683,411 B1
(45) Date of Patent: Jun. 20, 2017

(54) MULTIPLE BORE FLEXIBLE PIPE RISER SYSTEMS AND METHODS FOR DEPLOYMENT THEREOF

(71) Applicant: Chevron U.S.A. Inc., San Ramon, CA (US)

(72) Inventors: Christopher Allen Kassner, Houston, TX (US); Antonio C. F. Critsinelis, Kingwood, TX (US); Helena Miao, Houston, TX (US); Keiron Anson, Perth (AU)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 15/068,855

(22) Filed: Mar. 14, 2016

(51) Int. Cl.

| | |
|---|---|
| ***E21B 17/01*** | (2006.01) |
| ***F16L 1/16*** | (2006.01) |
| ***F16L 1/028*** | (2006.01) |
| ***E21B 43/01*** | (2006.01) |
| ***E21B 19/00*** | (2006.01) |

(52) U.S. Cl.
CPC ..... *E21B 17/015* (2013.01); *E21B 17/01* (2013.01); *E21B 17/012* (2013.01); *E21B 19/004* (2013.01)

(58) Field of Classification Search
CPC ..... E21B 17/015; E21B 17/01; E21B 17/012; E21B 19/004; E21B 43/01; F16L 1/16; F16L 1/028; B36B 22/01
See application file for complete search history.

(56) References Cited

U.S. PATENT DOCUMENTS

| | | | | |
|---|---|---|---|---|
| 7,426,936 | B2 * | 9/2008 | Gessaman | F16J 15/004 137/312 |
| 7,426,963 | B2 * | 9/2008 | O'Neill | E21B 17/01 166/365 |
| 8,573,308 | B2 | 11/2013 | Baugh | |
| 8,950,498 | B2 * | 2/2015 | Parsinejad | F17D 1/08 166/344 |
| 2003/0145991 | A1 * | 8/2003 | Olsen | E21B 37/00 166/265 |
| 2003/0170077 | A1 * | 9/2003 | Herd | E21B 17/015 405/224.2 |
| 2013/0022406 | A1 | 1/2013 | Roveri et al. | |
| 2013/0064606 | A1 | 3/2013 | Pionetti et al. | |
| 2014/0262316 | A1 | 9/2014 | Tan et al. | |

* cited by examiner

*Primary Examiner* — Matthew R Buck
*Assistant Examiner* — Douglas S Wood
(74) *Attorney, Agent, or Firm* — Karen R. DiDomenicis

(57) ABSTRACT

Disclosed are riser assemblies for connecting a topside structure and a subsea production facility. The assembly includes an upper riser having an upper end terminating at the topside structure, a flow diverting structure having an upper interface configured to connect to the upper riser and a lower interface configured to connect to at least two lower risers such that the upper riser is in communication with the at least two lower risers. Methods of deployment of the riser assemblies are also disclosed. The method includes connecting an upper riser to the topside structure, and connecting a first lower riser to a lower bore of the flow diverting structure such that the upper riser, the flow diverting structure and the first lower riser are connected, and the upper riser is in fluid communication with the first lower riser. Additional lower risers can be installed at a later time if desired.

14 Claims, 6 Drawing Sheets

MULTIPLE BORE FLEXIBLE PIPE RISER SYSTEMS AND METHODS FOR DEPLOYMENT THEREOF

FIELD

The present disclosure relates to marine riser assemblies and systems useful in offshore oil and gas production facilities, and to methods for the deployment thereof.

BACKGROUND

Subsea oil and gas production developments in recent years have been occurring in deeper water and thus entering more challenging offshore regions. Riser configuration designs are seeking to overcome numerous challenges such as highly dynamic offshore facility motions and environmental loadings, high top tension, and high hydrostatic pressure due to water depth. In practice, it has been demonstrated that in order to make deepwater large bore riser designs work, operators are frequently forced to utilize either very stable host topsides structures, e.g. spars, or more motion accommodating riser systems, e.g. freestanding hybrid riser (FSHR) systems. Both of these methods are currently used, but both of these methods have drawbacks. From a facility perspective, the use of a spar is not practical in some areas because of the lack of local export pipeline infrastructure. From a riser perspective, large bore risers encounter technical challenges as a result of the highly dynamic applications and sometimes do not meet strength and fatigue requirements. Existing deepwater riser systems such as FSHR have overcome dynamic application challenges by incorporating a flexible pipe jumper into the system design. However, this is a quite expensive solution due to system complexity and the installation requirements. In some instances, a design alternative to overcome technical and commercial challenges is to use a flexible pipe for the entire riser system. A particular challenge is the flexible pipe inner diameter limitation with increasing hydrostatic pressure resulting from increased water depth increasing the risk of collapse. In projects requiring large inner diameter risers, this may result in an increased riser count with smaller diameters if flexible pipe is being used, or it may completely eliminate flexible pipe as a riser option. Increased riser count requires multiple hang off slots on the topside structure, seabed congestion and results in capital expense increase.

There exists a need for motion accommodating riser systems useful in deepwater oil and gas developments which would avoid the above mentioned challenges with existing flexible pipe riser systems.

SUMMARY

In one aspect, a riser assembly is provided for transporting fluids between a topside structure at a topside location and a subsea fluid handling component at a subsea location. The riser assembly includes an upper riser capable of transporting fluids having an upper end terminating at the topside structure. The riser assembly includes a flow diverting structure capable of allowing fluids to pass therethrough and having an upper interface having a single upper bore configured to connect to the upper riser and a lower interface having at least two lower bores in fluid communication with the single upper bore. The lower interface is configured to connect to at least two lower risers.

In another aspect, a system is provided for transporting fluids between a topside structure at a topside location and a subsea fluid handling component at a subsea location. The system includes the above described riser assembly, and further includes at least two lower risers capable of transporting fluids connected to and in fluid communication with the flow diverting structure, wherein each of the at least two lower risers is connected to one of the at least two bores, such that the upper riser is in fluid communication with the at least two lower risers.

In another aspect, a method of deployment of a riser system for transporting fluids between a topside structure at a topside location and a subsea fluid handling component at a subsea location is provided. The method includes connecting the riser assembly to the topside structure such that the upper riser of the riser assembly terminates at the topside structure. The method further includes connecting a first lower riser to one of the at least two lower bores of the flow diverting structure such that the upper riser, the flow diverting structure and the first lower riser are connected, and the upper riser is in fluid communication with the first lower riser. This permits the lower risers to be installed at a later time if desired.

DESCRIPTION OF THE DRAWINGS

These and other objects, features and advantages of the present invention will become better understood with reference to the following description, appended claims and accompanying drawings where:

DETAILED DESCRIPTION

Figure 1A:
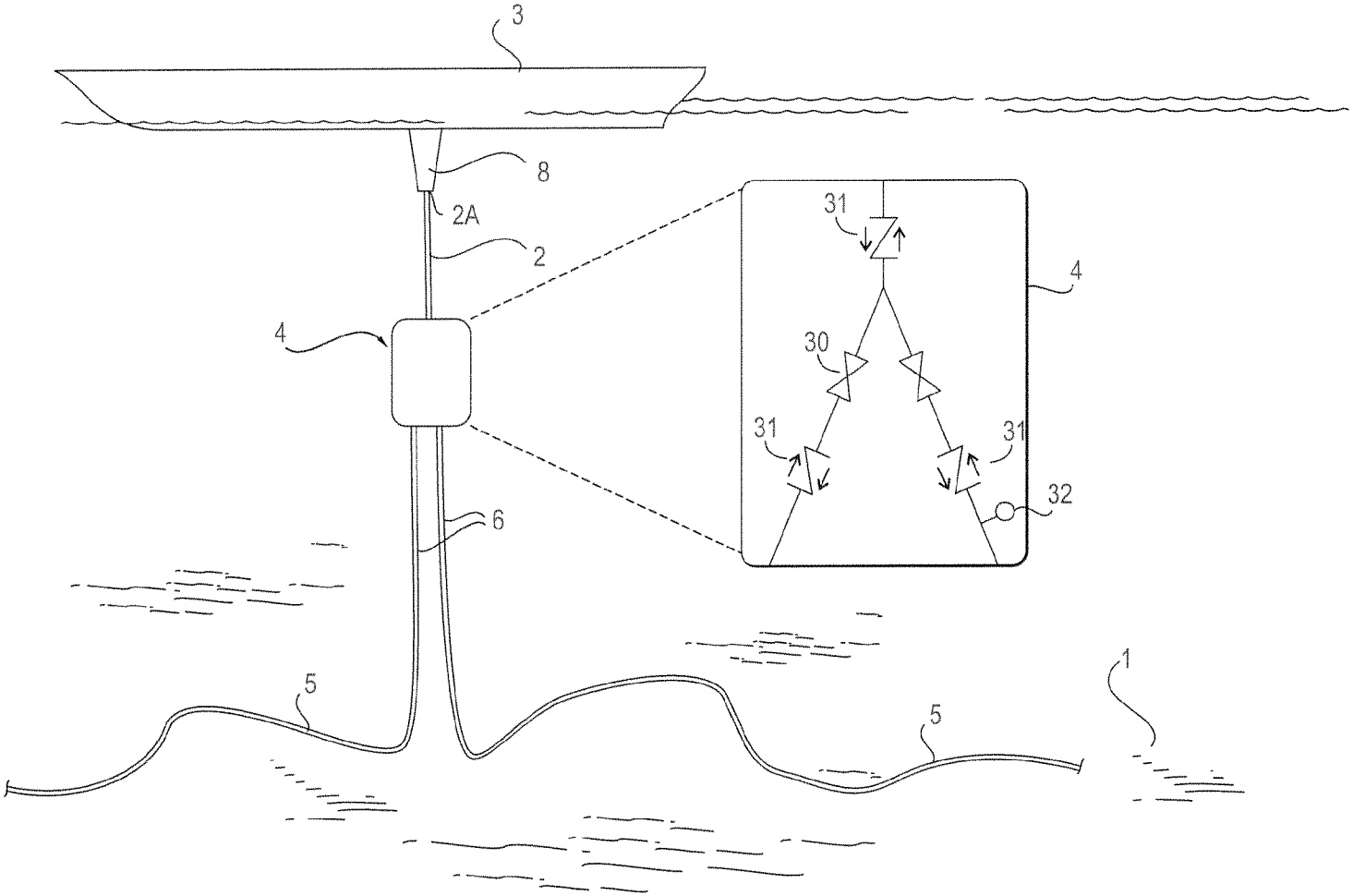
FIG. 1A is a simplified illustration of a system utilizing a riser assembly including a flow diverting structure according to an exemplary embodiment.

A riser assembly and a system using the riser assembly will now be described. FIG. 1A shows a riser assembly in a deployed position in which the assembly is being used for transporting production fluids. In one embodiment, the riser assembly is provided that is useful for transporting fluids between a topside structure 3 at a topside location and a subsea fluid handling component 5 at a subsea location, e.g., on the seabed 1. In one embodiment, the riser assembly includes an upper riser 2 capable of transporting fluids having an upper end 2*a* terminating at a topside structure 3, also referred to as a production unit topside structure 3. The topside structure 3 can be, for example, a floating vessel, a floating platform, a floating production and storage unit, a semi-submersible vessel, or a fixed platform. The subsea fluid handling component 5 can be, for example, a flowline, a pipeline end termination, a manifold, a subsea tree, an umbilical termination assembly, or a combination thereof.

The subsea fluid handling component 5 is positioned on the seabed 1. In one embodiment, the upper riser 2 can be a multilayered flexible pipe, a rigid pipe, a composite pipe, or a combination thereof. In one embodiment, the upper riser 2 has an inner diameter between about 6 inches (15 cm) and about 30 inches (76 cm). In one embodiment, the upper riser 2 has a depth capability of up to 1000 meters.

A flow diverting structure 4, also referred to herein as a diverting structure 4, capable of allowing fluids to pass therethrough is configured to connect to the upper riser 2. The upper riser can be disconnectable from, or reversibly connectable to, the diverting structure 4. The flow diverting structure 4, shown schematically, has an upper interface having a single upper bore therethrough and a lower interface having at least two lower bores therethrough. The at least two lower bores are in fluid communication with the single upper bore. The at least two lower bores are configured to connect to at least two lower risers 6. The lower risers 6 can be disconnectable from, or reversibly connectable to, the diverting structure 4. In one embodiment, the riser assembly further includes the at least two lower risers 6. In one embodiment, the at least two lower risers 6 can each be a multilayered flexible pipe, a rigid pipe, a composite pipe, or a combination of thereof. In one embodiment, each of the at least two lower risers 6 has an inner diameter between about 4 inches (10 cm) and about 16 inches (41 cm). In one embodiment, each of the at least two lower risers 6 has a depth capability of up to 3000 meters. When the upper riser 2, the flow diverting structure 4 and the at least two lower risers 6 are connected, the upper riser 2 is in fluid communication with the at least two lower risers 6.

In one embodiment, the flow diverting structure 4 can be a wye connector having an upper interface having a single upper bore and a lower interface having at least two lower bores. Nonlimiting examples of such wye connectors are disclosed in U.S. Pat. No. 8,616,074 (Kearns et al.). The single upper bore of the wye connector can be directly connected to the upper riser 2, and the two lower bores of the wye connector can be directly connected to the lower risers 6. In one embodiment, the flow diverting structure 4 further has an interface for launching and receiving a subsea pig into and out of the flow diverting structure 4. A subsea pig launcher and receiver can be integrated to the flow diverting structure 4 or can be temporarily assembled to the flow diverting structure 4 as a modular sub-component.

In one embodiment, the flow diverting structure 4, also referred to as the diverting structure 4, can further include at least one isolation valve 30 there within for isolating flow between the upper riser 2 and any of the at least two lower risers 6. In one embodiment, the flow diverting structure 4, can further include at least one check valve 31 there within for preventing flow in a direction as desired between the upper riser 2 and any of the at least two lower risers 6. In one embodiment, the diverting structure 4 can further include additional instrumentation 32. Such instrumentation can include a flow meter, a pressure sensor, a temperature sensor, a subsea sampling device, or a combination thereof.

In one embodiment, the riser assembly further includes a hang-off module 8 configured to connect to the topside structure 3 and the upper end 2*a* of the upper riser 2. The hang-off module 8 provides fluid communication between the upper riser 2 and piping (not shown) located on the topside structure 3. The hang-off module 8 restrains the mechanical loads, tensile loads and bending loads imparted from the riser assembly. In one embodiment, the hang-off module 8 can be a piping flange.

Figure 1B:
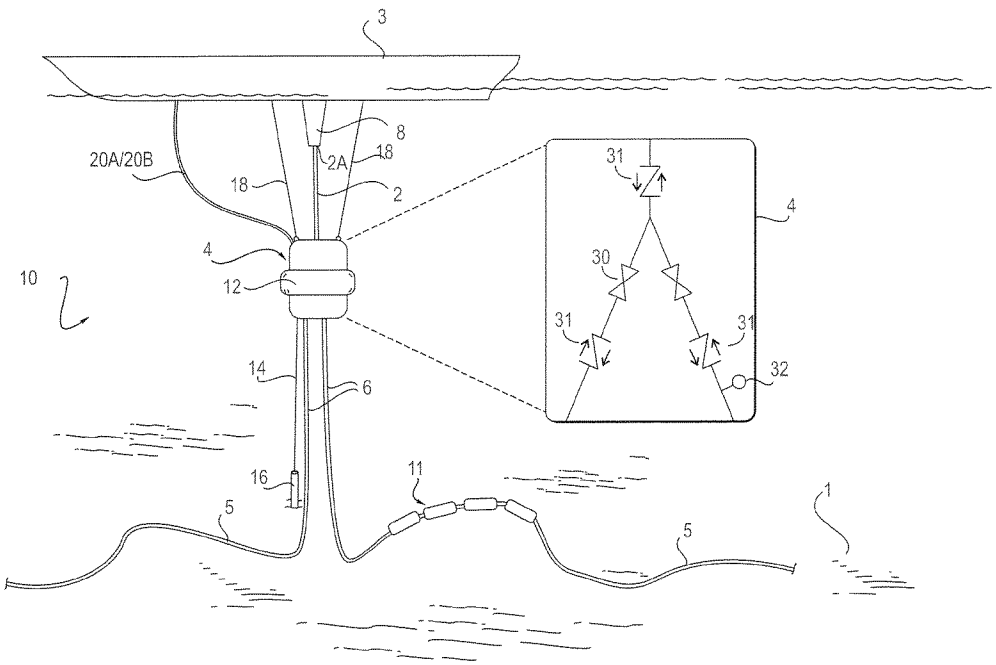
FIG. 1B is a simplified illustration of a system utilizing a riser assembly including a flow diverting structure according to an exemplary embodiment and including optional components.

In one embodiment, as illustrated in FIG. 1B, an optional tether 14 can be used to connect the lower interface of the flow diverting structure 4 to a seabed anchor such as a suction pile 16 to stabilize the riser assembly 10. Likewise, in one embodiment, an optional tether 18 can be used to connect the upper interface of the flow diverting structure 4 to the topside structure 3 to stabilize the riser assembly 10.

In one embodiment, at least one optional buoyancy element 12 can be connected to the diverting structure 4 to position the diverting structure 4 at a desired, predetermined water depth. Likewise, in one embodiment, at least one optional buoyancy element 11 can be connected to the upper riser and/or one or more of the lower risers. In one embodiment, the flow diverting structure 4 is located at a predetermined water depth determined by calculating a depth of hydrostatic collapse and a top tension capacity of the upper riser 2. In one embodiment, the predetermined water depth is from about 500 meters to about 3000 meters.

In some embodiments, the diverting structure 4 can further include an interface for the connection of a service line 20A operable from the production unit topside structure 3 which can be a multi service vessel (MSV). The service line 20A can be provided for injecting fluids such as gas lift, nitrogen and chemicals as desired into the riser assembly 10. Such fluids can assist in increasing production of fluids as may be desirable depending upon reservoir pressure. Chemicals can assist in preventing hydrate formation. The service line 20A can also be used for flow back after well intervention or stimulation to provide an alternative path for flow back fluids rather than through the upper riser 2. In one embodiment, the flow diverting structure 4 can be used as an access point for intervention in the riser assembly, e.g., for riser inspection. In one embodiment, the diverting structure 4 can further include an interface for the connection of a service line operable from the production unit topside structure 3 for receiving fluids such as well fluids flow back from well stimulation.

In one embodiment, the diverting structure 4 can further include an interface for the connection of a control umbilical 20B. Such a control umbilical 20B can be used to remotely control the functions in the diverter structure 4, such as opening and closing of valves, controlling power and communication for sensors and monitoring devices, launching and receiving pigs, and the like. The diverting structure 4 can further include an interface for operating the control umbilical 20B. The control umbilical 20B can be operable from the topside structure 3.

Figure 2:
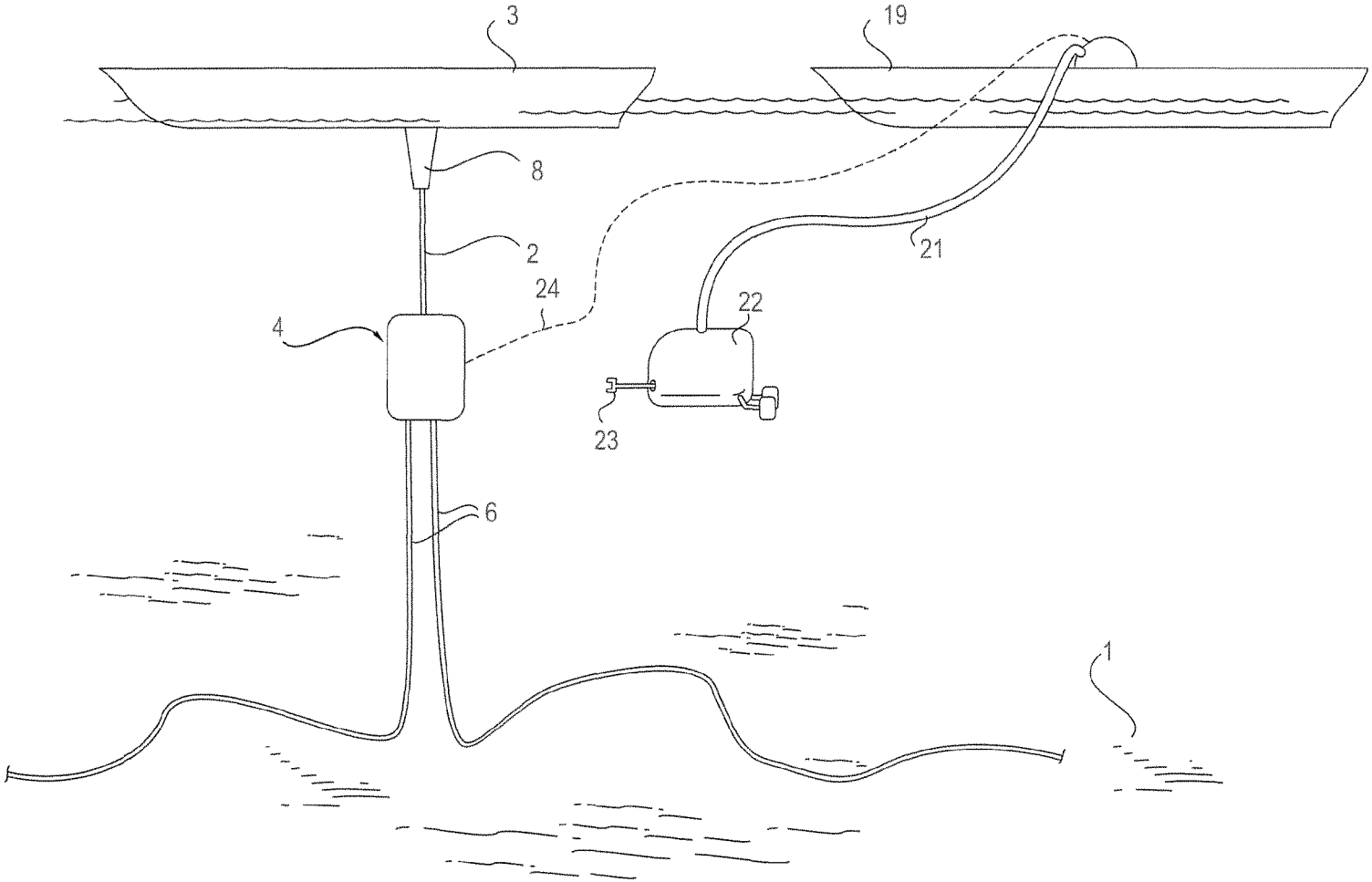
FIG. 2 is a simplified illustration of alternative intervention methods utilizing a riser assembly according to an exemplary embodiment.

FIG. 2 illustrates intervention methods using the riser assembly according to some embodiments. In one embodiment, intervention fluid can be supplied from a multiservice vessel (MSV) 19 through line 21 to an interface on the flow diverting structure 4. An ROV 22 having a hot stab 23 can be used to connect line 21 to the flow diverting structure 4. In one embodiment, line 21 can be a length of coil tubing. The intervention fluid can be a hydrate inhibitor for hydrate remediation. Alternatively, line 24 can connect MSV 19 to the flow diverting structure 4 such that a bidirectional flow path is established.

In one embodiment, the upper riser 2 and the at least two lower risers 6 include at least one umbilical passing therethrough. One of the at least one umbilicals can pass through the upper riser 2 and one of the at least two lower risers 6.

Figure 3:
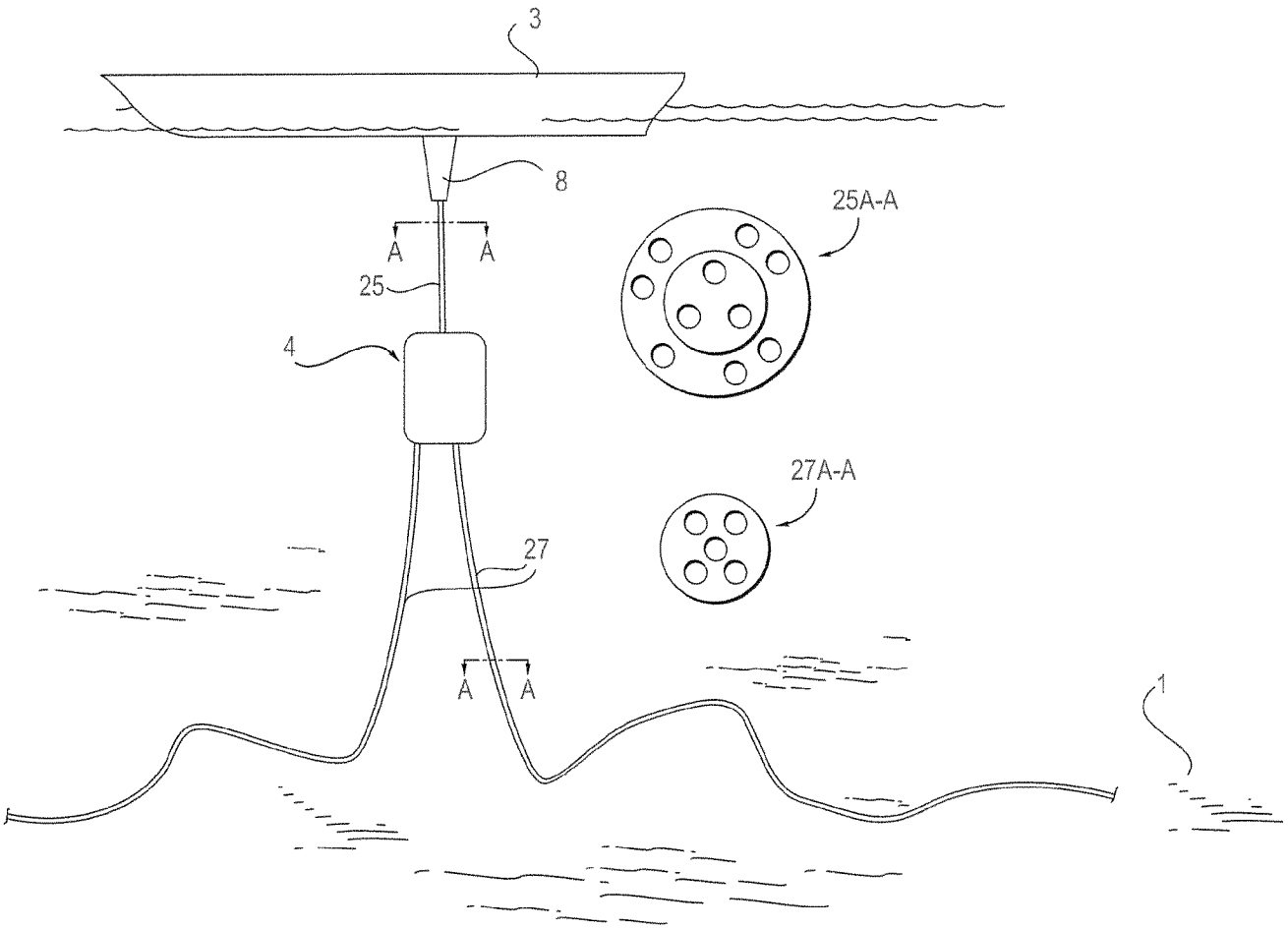
FIG. 3 is a simplified illustration of an umbilical system according to an exemplary embodiment.

In embodiments as illustrated in FIG. 3, an umbilical assembly connecting the topside structure 3 and a subsea facility at a subsea location is provided. Upper umbilical riser 25 connects to at least two lower umbilical risers 27 by way of an umbilical breakout structure 4. Umbilical breakout structure 4 has an upper interface for connecting to the upper umbilical riser 25 and a lower interface for connecting to the at least two lower umbilical risers 27. In one embodiment, the umbilical risers 25 and 27 can be control umbilicals containing hydraulic, communication, and/or electrical functional elements. The functions within the upper umbilical riser 25 are split up within the umbilical breakout structure 4 and are reassigned to the at least two lower umbilical risers 27. As shown in FIG. 3, 10 functions and upper umbilical riser 25 are split into five functions each in two lower umbilical risers 27, as can be seen in the cross-section 25A-A of upper umbilical riser 25 and the cross-section 27A-A of lower umbilical risers 27.

In one embodiment, a method of deployment of a riser system for transporting fluids between a topside structure 3 at a topside location and a subsea fluid handling component 5 at a subsea location is provided. The method includes connecting the riser assembly to the topside structure 3 such that the upper end 2*a* of the upper riser 2 terminates at the hang off module 8 connected to the topside structure 3. At such point in time or at a later time, a first lower riser 6 can be connected to one of the at least two lower bores of the flow diverting structure 4 such that the upper riser 2, the flow diverting structure 4 and the first lower riser 6 are connected and the upper riser 2 is in fluid communication with the first lower riser 6. At this point the system can be operated using only the first lower riser 6 to transport fluids. At a later point in time, the capacity of the riser system can be expanded by connecting a second or additional lower riser 6 to another of the at least two lower bores of the flow diverting structure 4. In this way, the invention enables phase development of a subsea facility with the ability to install one of the lower risers 6 initially and additional lower riser(s) 6 at a later date as needed.

Figure 4:
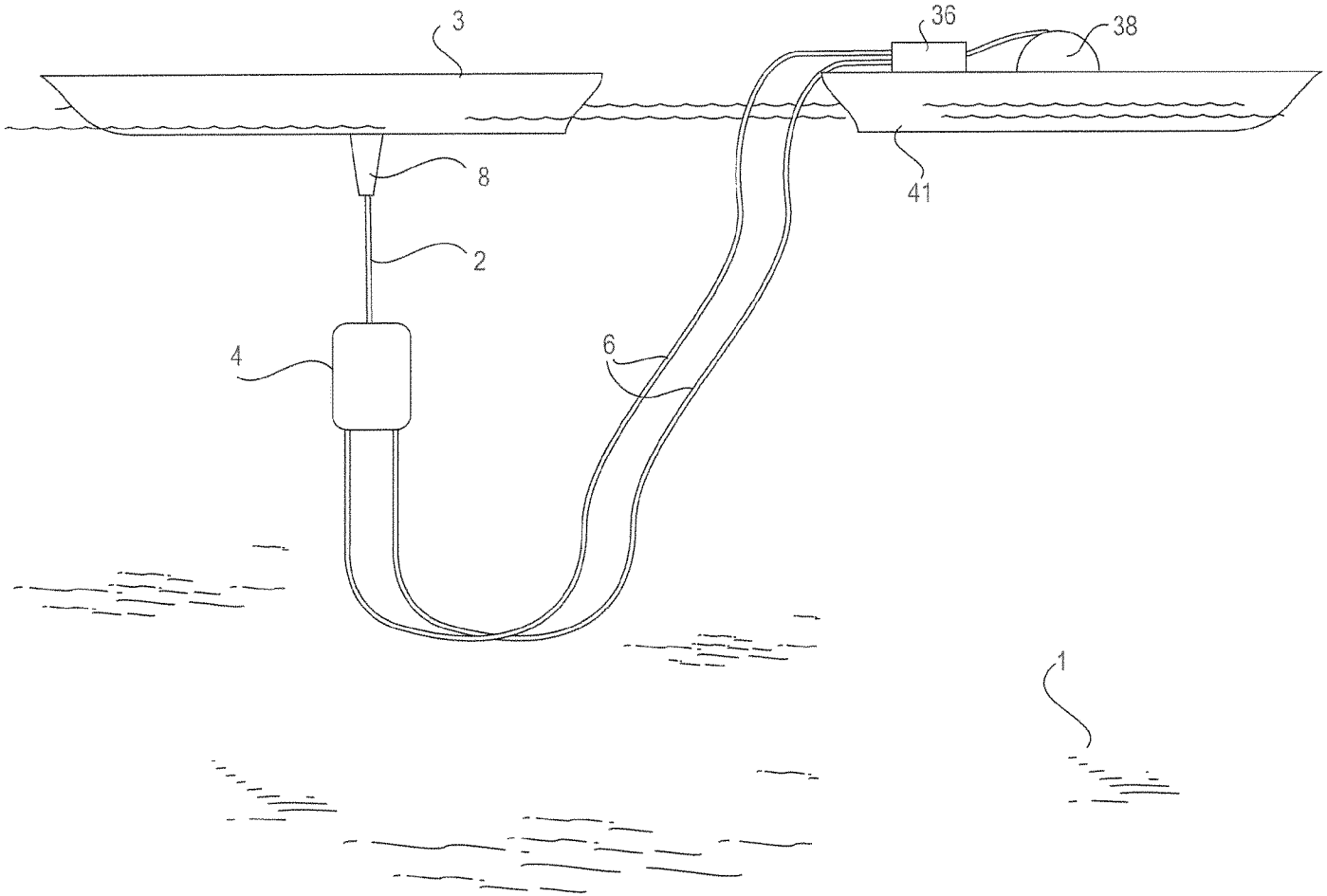
FIG. 4 is a simplified illustration of a method for installing a riser assembly according to an exemplary embodiment.

One embodiment of a method of deployment of a riser system is illustrated in FIG. 4. The upper riser 2 and flow diverting structure 4 are initially connected to the hang off module 8. An installation vessel 41 equipped with a dual reel 38 and a dual tensioner 36 carries the lower risers 6 to a location an appropriate distance from the topside structure 3 from which the lower risers 6 can be connected to the flow diverting structure 4 already installed. The dual reel 38 on the installation vessel 41 can then let out length in the lower risers 6. The installation vessel 41 can move away from the topside structure 3 during installation is desired to lay down the lower risers 6 simultaneously onto the seabed 1.

Figure 5:
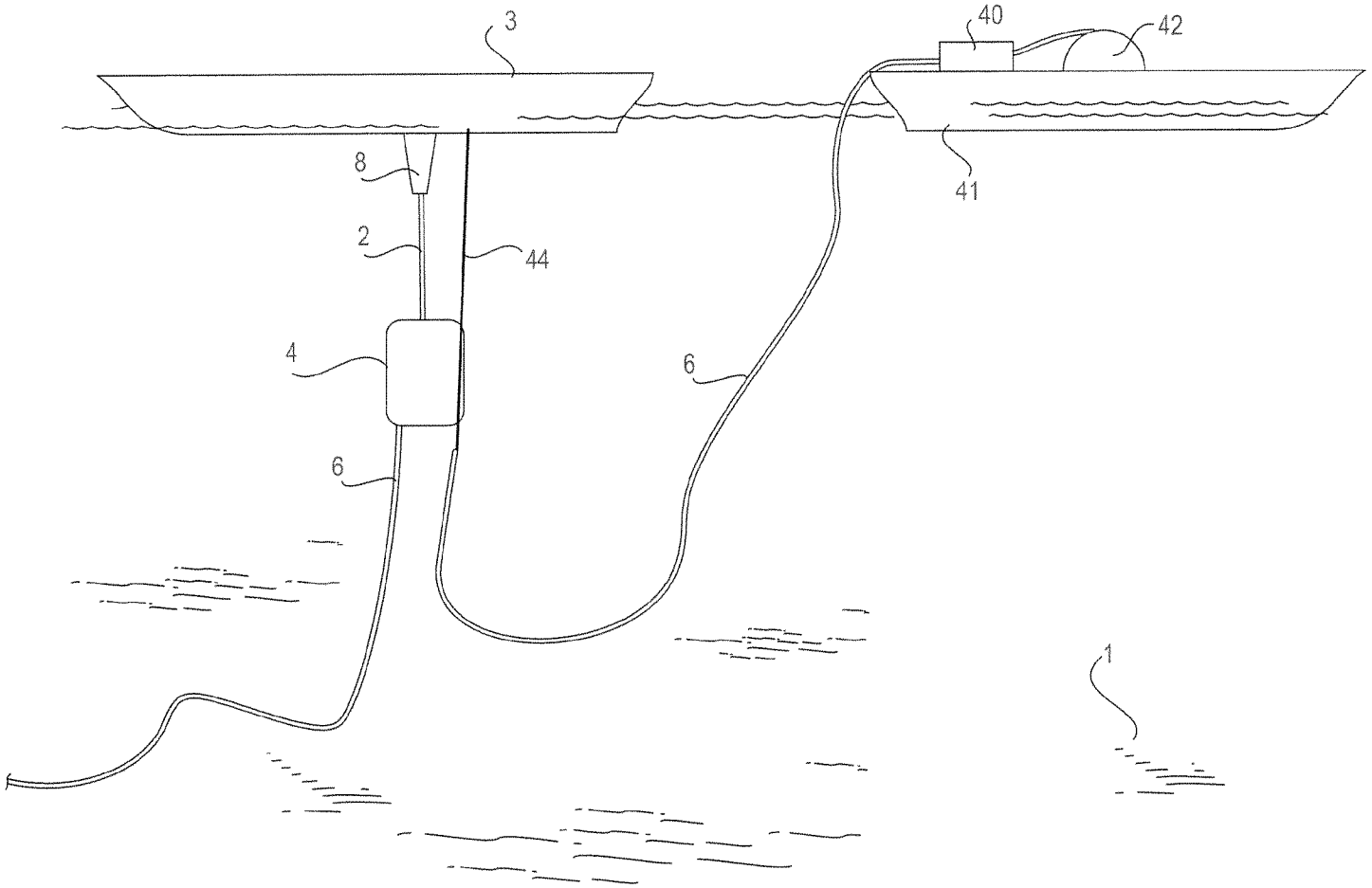
FIG. 5 is a simplified illustration of a method for installing a riser assembly according to another exemplary embodiment.

An alternative embodiment of a method of deployment of a riser system is illustrated in FIG. 5. Again, the upper riser 2 and flow diverting structure 4 are initially connected to the hang off module 8. In this case, the installation vessel 41 is equipped with a single reel 42 and a single tensioner 40. The installation vessel 41 carries one of the lower risers 6 at a time. The installation vessel 41 carries one of the lower risers 6 to a location an appropriate distance from the topside structure 3 from which the lower riser 6 can be connected to the flow diverting structure 4 already installed. The reel 42 on the installation vessel 41 can then let out length in the lower riser 6. The installation vessel 41 can move away from the topside structure 3 during installation is desired to lay down the lower riser 6 onto the seabed 1. A pull in winch wire 44 can be used to hold the free end of the lower riser 6 to be connected to the flow diverting structure 4 from the topside structure 3.

A number of advantages can be realized using the riser assembly shown in FIG. 1A (assembly including fluid production risers) or the umbilical assembly shown in FIG. 3 (assembly including umbilical risers) of the present disclosure. The topside pull in capacity requirements can be reduced since only the top riser (2 or 25) must be pulled in. Improved riser response can be realized due to improved stability of the overall system configuration. Repair and/or replacement of only certain section(s) of the riser assembly or umbilical assembly is possible rather than the whole riser or umbilical system, which can reduce capital expense.

As compared with multiple small risers connected to the topside structure 3, fewer hang off slots on the topside structure 3 are required. Pipe design is already available for the upper riser 2 (up to 20 in inner diameter) and for the lower riser 6. The facility riser count overall can be reduced. As a result, riser pull in can be done more quickly.

As compared with FSHRs, the riser assembly of the present disclosure results in a much simpler system overall. A heavy lift vessel is not required for installation of the riser assembly, bottom riser assembly and buoyancy can. Riser installation can be accomplished much more quickly.

It should be noted that only the components relevant to the disclosure are shown in the figures, and that many other components normally part of a riser system are not shown for simplicity.

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and connected claims are approximations that can vary depending upon the desired properties sought to be obtained by the present invention. It is noted that, as used in this specification and the appended claims, the singular forms "a," "an," and "the," include plural references unless expressly and unequivocally limited to one referent.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

From the above description, those skilled in the art will perceive improvements, changes and modifications, which are intended to be covered by the appended claims.

What is claimed is:

1. A riser assembly for transporting fluids between a topside structure at a topside location and a subsea fluid handling component at a subsea location, comprising:

a. an upper riser capable of transporting fluids having an upper end terminating at the topside structure;

b. a flow diverting structure capable of allowing fluids to pass therethrough, the flow diverting structure having an upper interface having a single upper bore configured to connect to the upper riser and a lower interface having at least two lower bores in fluid communication with the single upper bore;

c. at least two lower risers capable of transporting fluids wherein each of the at least two lower risers is configured to connect to one of the at least two lower bores of the flow diverting structure; wherein when the upper riser, the flow diverting structure and the at least two lower risers are connected, the upper riser is in fluid communication with the at least two lower risers; and d. a control umbilical passing through the upper riser and one of the at least two lower risers;

wherein the diverting structure further comprises an interface for operating the control umbilical.

2. The riser assembly of claim 1, wherein the flow diverting structure comprises a piggable wye connector having a primary end comprising the single upper bore and two secondary ends comprising the at least two lower bores, the primary end configured to connect to the upper riser and the secondary ends configured to connect to two lower risers.

3. The riser assembly of claim 1, wherein the diverting structure further comprises an interface for launching and receiving a subsea pig into and out of the diverting structure.

4. The riser assembly of claim 1, wherein the diverting structure further comprises at least one isolation valve for isolating flow between the upper riser and any of the at least two lower risers.

5. The riser assembly of claim 1, wherein the diverting structure further comprises an interface for the connection of a service line operable from the topside structure for injecting a fluid into the riser assembly wherein the fluid comprises a gas for providing gas lift and/or a chemical composition for hydrate remediation.

6. The riser assembly of claim 1, wherein the diverting structure further comprises an interface for the connection of a service line operable from the topside structure for receiving fluids wherein the fluids comprise well fluids and/or flow back fluids from well stimulation.

7. The riser assembly of claim 1, wherein the diverting structure further comprises an interface for the connection of coil tubing.

8. The riser assembly of claim 1, wherein the diverting structure further comprises instrumentation selected from the group consisting of a flow meter, a pressure sensor, a temperature sensor, a subsea sampling device, and combinations thereof.

9. The riser assembly of claim 1, wherein the upper riser and the at least two lower risers are selected from the group consisting of multilayered flexible pipe, rigid pipe, composite pipe, and combinations thereof.

10. The riser assembly of claim 1, wherein the diverting structure comprises an umbilical breakout structure for splitting and reassigning functions from the control umbilical in the upper riser to the control umbilical in the one of the at least two lower risers.

11. The riser assembly of claim 1, wherein the upper riser has an inner diameter between about 6 inches and about 30 inches.

12. The riser assembly of claim 1, wherein each of the at least two lower risers has an inner diameter between about 4 inches and about 16 inches.

13. The riser assembly of claim 1, further comprising a buoyancy element connected to the diverting structure.

14. The riser assembly of claim 1, further comprising a buoyancy element connected to at least one of the upper riser and the at least two lower risers.

* * * * *